US007929898B2

(12) United States Patent
Shishikura

(10) Patent No.: US 7,929,898 B2
(45) **Date of Patent: *Apr. 19, 2011**

(54) WASTE TONER COLLECTING APPARATUS AND IMAGE FORMING APPARATUS

(75) Inventor: Kenichiro Shishikura, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/561,435

(22) Filed: Sep. 17, 2009

(65) Prior Publication Data

US 2010/0003039 A1 Jan. 7, 2010

Related U.S. Application Data

(63) Continuation of application No. 11/676,564, filed on Feb. 20, 2007, now Pat. No. 7,689,156.

(30) Foreign Application Priority Data

Feb. 20, 2006 (JP) ..... 2006-043116

(51) Int. Cl.
*G03G 21/00* (2006.01)

(52) U.S. Cl. ..... 399/358; 399/35; 399/120

(58) Field of Classification Search ..... 399/34, 399/35, 71, 107, 110, 119, 120, 343, 358, 399/359

See application file for complete search history.

(56) References Cited

U.S. PATENT DOCUMENTS

| | | | | |
|---|---|---|---|---|
| 5,848,342 | A * | 12/1998 | Tanda | 399/358 |
| 7,103,308 | B2 * | 9/2006 | Wakana | 399/358 |
| 7,292,817 | B2 | 11/2007 | Murakami et al. | |
| 7,426,365 | B2 | 9/2008 | Uchihashi | |
| 7,515,838 | B2 * | 4/2009 | Kadowaki et al. | 399/13 |

FOREIGN PATENT DOCUMENTS

| | | |
|---|---|---|
| JP | 08-036294 | 2/1996 |
| JP | 2002-148884 | 5/2002 |

* cited by examiner

*Primary Examiner* — Hoan Tran
(74) *Attorney, Agent, or Firm* — Turocy & Watson, LLP

(57) ABSTRACT

A tandem type image forming apparatus drives an agitation paddle when the waste toner defecated from a plurality of image forming units and flowed and collected in a single waste toner containing member by way of the first collection port thereof gets to a predetermined level in order to level the height of the waste toner in the waste toner containing member. The quantity of waste toner flowed by way of the first collection port is estimated from the quantity of the toners supplied from the toner cartridges of the development apparatus.

6 Claims, 8 Drawing Sheets

FIG. 5

TABLE 1

| | transfer ratio (%) |
|---|---|
| primary transfer Y | 96 |
| primary transfer M | 95 |
| primary transfer C | 94 |
| primary transfer K | 94 |
| transfer belt (secondary transfer) | 88 |

FIG. 6

TABLE 2

| | | | | primary transfer | | secondary transfer | |
|---|---|---|---|---|---|---|---|
| | quantity of supplied toner (g) | primary transfer ratio (%) | secondary transfer ratio (%) | quantity of toner adhering onto belt (g) | quantity of primary waste toner (g) | quantity of toner adhering onto sheet (g) | quantity of secondary waste toner (g) |
| Y | 35 | 96 | 88 | 33.60 | 1.40 | 29.57 | 4.03 |
| M | 35 | 95 | 88 | 33.25 | 1.75 | 29.26 | 3.99 |
| C | 35 | 94 | 88 | 32.90 | 2.10 | 28.95 | 3.95 |
| K | 35 | 94 | 88 | 32.90 | 2.10 | 28.95 | 3.95 |

when each color is used by 35g (35 × 4g)

total quantity of secondary waste toner 15.92

FIG. 7

TABLE 3

| image density | pale | | normal | | dense |
|---|---|---|---|---|---|
| correction coefficient | 0.8 | 0.9 | 1 | 1.1 | 1.2 |

FIG. 8

TABLE 4

| temperature (°C) | 0 | 5 | 10 | 15 | 20 | 25 | 30 | 35 |
|---|---|---|---|---|---|---|---|---|
| correction coefficient | 1.020 | 1.015 | 1.010 | 1.005 | 1.000 | 0.995 | 0.990 | 0.985 |

FIG. 9

TABLE 5

| humidity (%) | 10 | 20 | 30 | 40 | 50 | 60 | 70 | 80 |
|---|---|---|---|---|---|---|---|---|
| correction coefficient | 1.020 | 1.015 | 1.010 | 1.005 | 1.000 | 0.995 | 0.990 | 0.985 |

FIG. 10

TABLE 6

| steam pressure (mmHg) | 1 | 5 | 10 | 15 | 20 | 25 | 30 | 35 |
|---|---|---|---|---|---|---|---|---|
| correction coefficient | 1.020 | 1.015 | 1.010 | 1.005 | 1.000 | 0.995 | 0.990 | 0.985 |

FIG. 11

TABLE 7

| primary transfer bias voltage (V) | 500 | 1000 | 1500 | 2000 | 2500 | 3000 | 3500 | 4000 |
|---|---|---|---|---|---|---|---|---|
| correction coefficient | 0.985 | 0.990 | 0.995 | 1.000 | 1.005 | 1.010 | 1.015 | 1.020 |

FIG. 12

TABLE 8

| sheet type | thin sheet | ordinary sheet | thick sheet category 1 | thick sheet category 2 | thick sheet category 3 | thick sheet category 4 |
|---|---|---|---|---|---|---|
| correction coefficient | 1.05 | 1.10 | 1.15 | 1.20 | 1.25 | 1.30 |

FIG. 13

TABLE 9

| | |
|---|---|
| thin sheet | 64 $g/m^2$ or less |
| ordinary sheet | 64 to 105 $g/m^2$ |
| thick sheet category 1 | 106 to 163 $g/m^2$ |
| thick sheet category 2 | 164 to 209 $g/m^2$ |
| thick sheet category 3 | 210 to 256 $g/m^2$ |
| thick sheet category 4 | 256 $g/m^2$ or more |

FIG. 15

TABLE 10

Test results for different numbers of rotations

| period of driving operation (seconds) | 5 | 10 | 15 | 20 |
|---|---|---|---|---|
| weight of waste toner at time of detection (g) | 350 | 300 | 250 | 230 |

FIG. 16

TABLE 11

Test result for different rotation thresholds

| quantity of waste toner for rotation threshold (g) | 16 | 8 | 5 | 4 |
|---|---|---|---|---|
| weight of waste toner at time of detection (g) | 350 | 300 | 250 | 230 |

WASTE TONER COLLECTING APPARATUS AND IMAGE FORMING APPARATUS

CROSS REFERENCE TO RELATED APPLICATION

This application is a Continuation of application Ser. No. 11/676,564 filed on Feb. 20, 2007, which is based upon and claims the benefit of priority from prior Japanese Patent Application No. 2006-43116 filed on Feb. 20, 2006, the entire contents of both of which are incorporated herein by reference.

BACKGROUND OF THE INVENTION

1. Field of the Invention

The present invention relates to a waste toner collecting apparatus for collecting waste toner used in an electronic photography type copying machine, a printer or the like adapted to produce a color image by laying toner images of a plurality of different colors one on the other. This invention also relates to an image forming apparatus.

2. Description of the Related Art

A cleaning apparatus is normally operated to remove toner remaining on a photosensitive member of an image forming apparatus such as a copying machine or a printer after the end of an image transfer process. The toner removed from the photosensitive member is collected in a waste toner box as waste toner. When the waste toner box becomes full, it is replaced by a new one.

Tandem type image forming apparatus have been marketed in recent years. A plurality of image forming units, each having a photosensitive member, are arranged in parallel in a tandem type image forming apparatus and the toner images of different colors formed on the respective photosensitive members are transferred onto a single sheet of paper and laid one on the other to produce a color image. Residual toner is remained from each of the photosensitive members of such a tandem type image forming apparatus. When a transfer medium such as an intermediate transfer belt is employed, residual toner is remained also on the transfer medium.

When the residual toner from the plurality of photosensitive members and on the transfer medium is collected into a single waste toner box extending in the direction of arrangement of the photosensitive members, a heap of accumulated waste toner is formed in the waste toner box for each of the photosensitive members and the transfer medium. To cope with this problem, apparatus have been proposed for leveling down the heaps of waste toner accumulated in the waste toner box by means of an auger so as to increase the quantity of waste toner that can be contained in the waste toner box. For example, Jpn. Pat. Publication (Kokai) No. 2002-148884 discloses such an apparatus. Apparatus have also been proposed for detecting the volume of developer in the development unit and controls the number of rotations of the paddles for drawing up developer onto the development rollers of the development unit. For example, Jpn. Pat. Publication (Kokai) No. 8-36294 discloses such an apparatus.

However, the former known apparatus do not pay attention to the control of the auger. In other words, the auger or some other leveling member is driven to operate simply when the number of sheets where images are formed gets to a predetermined value. If images are formed with a low image density, it may be not necessary to level down the waste toner in the waste toner box when the number of image-bearing sheets gets to a predetermined value.

Generally, the number of rotation of the leveling member is designed to operate on an assumption that images are formed with a high image density and waste toner is defecated at a relatively high rate from the viewpoint of preventing a waste toner collecting mechanism from being broken down and improving the safety of the mechanism. In other words, the leveling member is driven to operate frequently on an assumption that waste toner is defecated at a relatively high rate. When the leveling member is driven to rotate frequently, so much flying toner is occurred in the waste toner box.

On the other hand, in the case of apparatus adapted to detect a full condition of the waste toner box typically by means of an optical sensor, the full condition detecting section of the apparatus can erroneously detect a full condition in the waste toner box when it is stained by flying toner.

Thus, there is a demand for an arrangement for satisfactorily leveling waste toner in a waste toner box and efficiently collecting waste toner, while minimizing flying toner in the waste toner box in order to prevent the full condition detecting section from detecting a full condition in error due to the smudge thereof given by flying toner when the waste toner defecated from a plurality of image forming units and a transfer medium is collected in the single waste toner box.

SUMMARY OF THE INVENTION

An aspect of the present invention is to reliably level the waste toner in a waste toner box to improve the safety of a waste toner collecting mechanism when collecting the waste toner defecated from a plurality of image forming units and a transfer medium into the single waste toner box, and also minimize the flying toner occurred when leveling the waste toner and prevent flying toner from adhering to the full condition detecting section of the waste toner collecting mechanism, and give rise to erroneous detections, so that the waste toner box may be effectively exploited.

According to an embodiment of the present invention, a waste toner collecting apparatus includes: a waste toner containing member extending in the direction of arrangement of a plurality of image forming units respectively having toner image forming members arranged around image carriers so as to contain the waste toner conveyed out from the plurality of image forming units; and a leveling member arranged in the waste toner containing member and adapted to rotate according to the quantity of waste toner in the waste toner containing member.

BRIEF DESCRIPTION OF THE DRAWINGS

FIG. 5 is Table 1 illustrating the primary transfer ratios and the secondary transfer ratio according to the embodiment of the present invention;

FIG. 6 is Table 2 illustrating the transferred quantities and the waste toner quantities of toners of different colors relative to the supplied quantities of toners according to the embodiment of the present invention;

FIG. 7 is Table 3 illustrating the image density correction coefficients of the consumed quantity of toner according to the embodiment of the present invention;

FIG. 8 is Table 4 illustrating the correction coefficients of the number of rotations of the conveyance paddles for temperature fluctuations according to the embodiment of the present invention;

FIG. 9 is Table 5 illustrating the correction coefficients of the number of rotations of the conveyance paddles for humidity fluctuations according to the embodiment of the present invention;

FIG. 10 is Table 6 illustrating the correction coefficients of the number of rotations of the conveyance paddles for steam pressure fluctuations according to the embodiment of the present invention;

FIG. 11 is Table 7 illustrating the correction coefficients of the number of rotations of the conveyance paddles for fluctuations of the primary transfer bias voltage according to the embodiment of the present invention;

FIG. 12 is Table 8 illustrating the correction coefficients of the number of rotations of the conveyance paddles for different types of sheets according to the embodiment of the present invention;

FIG. 13 is Table 9 illustrating the definitions of sheets according to the embodiment of the present invention;

FIG. 15 is Table 10 illustrating some of the results of a waste toner collecting test according to the embodiment of the present invention; and FIG. 16 is Table 11 also illustrating some of the results of a waste toner collecting test according to the embodiment of the present invention.

DETAILED DESCRIPTION OF THE INVENTION

Figure 1:
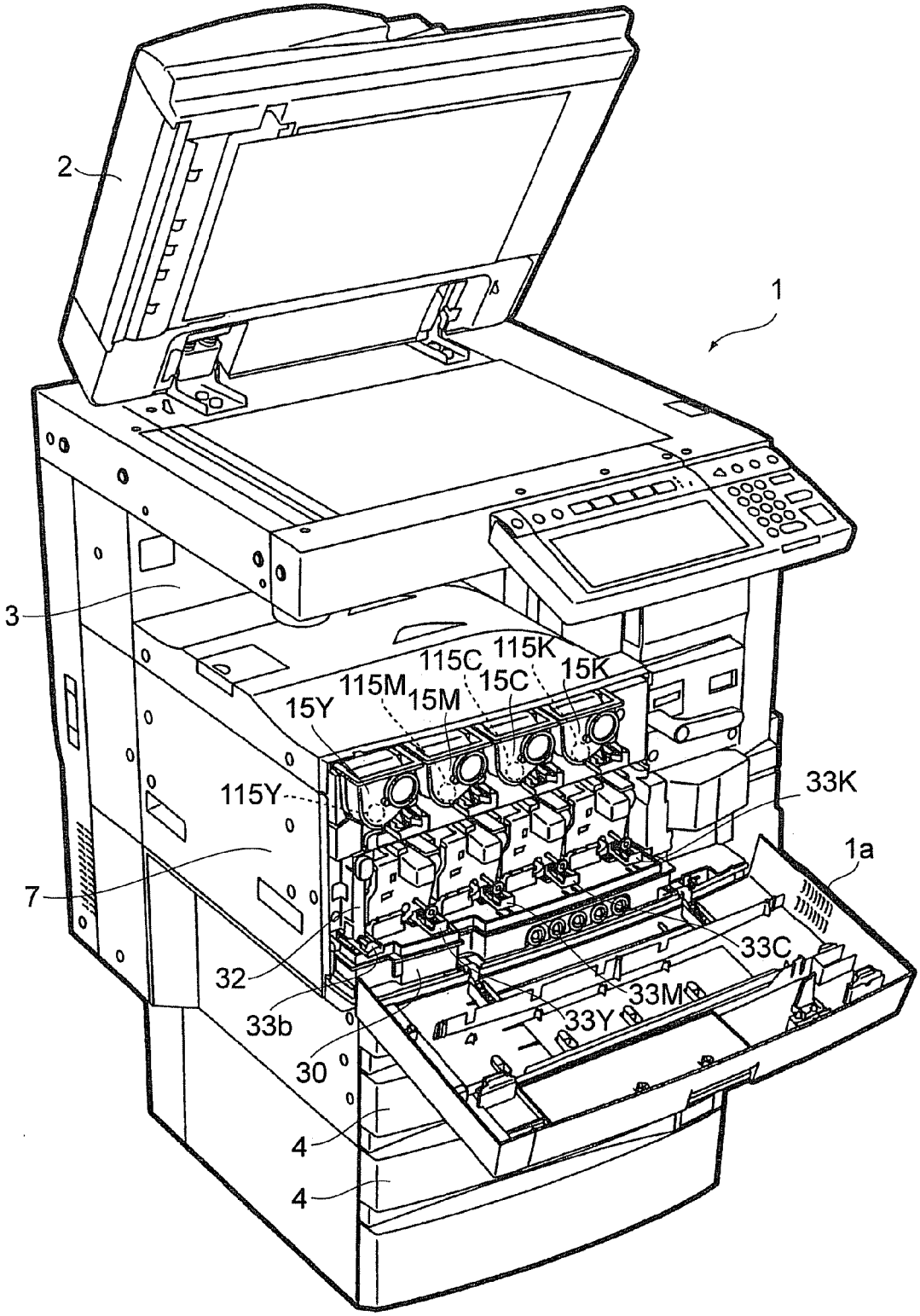
FIG. 1 is a schematic perspective view according to an embodiment of the present invention, which is a color copying machine, showing the appearance thereof when its front cover is opened.
Figure 2:
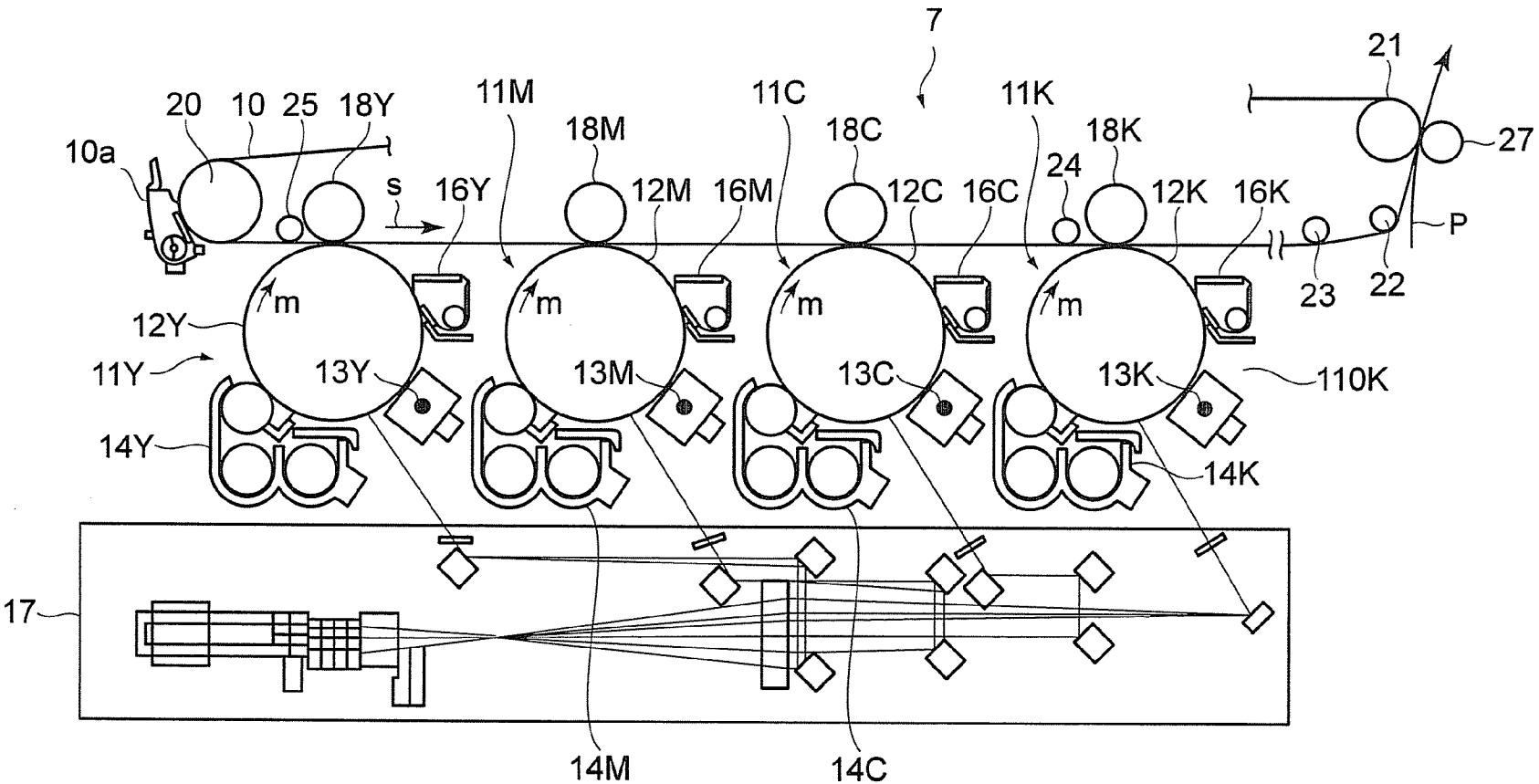
FIG. 2 is a schematic illustration of an image forming section according to the embodiment of the present invention.

Now, a preferred embodiment of the present invention will be described in greater detail by referring to the accompanying drawings. FIG. 1 is a schematic perspective view according to an embodiment of the present invention, which is a 4-unit tandem type color copying machine 1, showing the appearance thereof when its front cover 1*a* is opened. FIG. 2 is a schematic illustration of an image forming section 7 of the color copying machine 1, showing the configuration thereof. The color copying machine 1 comprises a scanner section 2 and an inter-body sheet eject section 3 arranged in an upper part thereof. The color copying machine 1 further comprises four image forming units 11Y, 11M, 11C and 11K arranged in parallel below an intermediate transfer belt 10 as a transfer medium for yellow (Y), magenta (M), cyan (C) and black (K) images respectively and adapted to be driven in the direction of arrow s.

The image forming units 11Y, 11M, 11C and 11K respectively have photosensitive drums 12Y, 12M, 12C and 12K that are image carriers. Electric chargers 13Y, 13M, 13C and 13K, development apparatus 14Y, 14M, 14C and 14K that are development sections, and photosensitive member cleaning apparatus 16Y, 16M, 16C and 16K, they are constitute toner image forming members are arranged respectively around the photosensitive drums 12Y, 12M, 12C and 12K in the mentioned order in the direction of rotation thereof as indicated by arrows m. Laser beams are irradiated respectively onto the surfaces of the photosensitive drums 12Y, 12M, 12C and 12K from a laser exposure apparatus 17 in the spans from the electric chargers 13Y, 13M, 13C and 13K to the development apparatus 14Y, 14M, 14C and 14K arranged around the respective photosensitive drums.

The electric chargers 13Y, 13M, 13C and 13K uniformly charge the surfaces of the respective photosensitive drums 12Y, 12M, 12C and 12K with electricity to about −700V, for example. The development apparatus 14Y, 14M, 14C and 14K supply the photosensitive drums 12Y, 12M, 12C and 12K with two-component developers containing respectively yellow (Y), magenta (M), cyan (C) and black (K) toners and carrier. The development apparatus 14Y, 14M, 14C and 14K are sensing the respective toner densities by means of density sensors. The development apparatus 14Y, 14M, 14C and 14K are supplied respectively with yellow (Y), magenta (M), cyan (C) and black (K) toners from toner cartridges 15Y, 15M, 15C and 15K that are supply sections so as to keep the toner densities to a constant level.

The toner cartridges 15Y, 15M, 15C and 15K are equipped respectively with conveyance paddles 115Y, 115M, 115C and 115K for supplying the development apparatus 14Y, 14M, 14C and 14K with respective toners. For example, the conveyance paddles 115Y, 115M, 115C and 115K are so designed that each of them supplies toner by 0.035 g while it is driven to make a full turn. Alternatively, for example the conveyance paddles 115Y, 115M, 115C and 115K may be so designed that each of them supplies toner by 0.035 g while the drive motor is driven to operate for a second.

The laser exposure apparatus 17 scans the photosensitive drums 12Y, 12M, 12C and 12K in the respective axial directions by means of the laser beams emitted from a semiconductor laser element to form images on the photosensitive drums 12Y, 12M, 12C and 12K by way of a focusing lens system.

The intermediate transfer belt 10 is made of a stable material in terms of heat resistance and abrasion resistance, which may be a semiconductor polyimide for example. The intermediate transfer belt 10 is wound around a drive roller 21, a follower roller 20 and first through fourth tension rollers 22 through 25 and held at tension. A primary transfer voltage is applied to the intermediate transfer belt 10 at the primary transfer positions thereof where it faces the photosensitive drums 12Y, 12M, 12C and 12K by means of respective primary transfer rollers 18Y, 18M, 18C and 18K so that the toner images on the photosensitive drums 12Y, 12M, 12C and 12K are transferred onto the intermediate transfer belt 10 in a primary transfer operation. After the completion of the primary transfer operation, the photosensitive member cleaning apparatus 16Y, 16M, 16C and 16K respectively collect the residual toners on the photosensitive drums 12Y, 12M, 12C and 12K as waste toner.

A secondary transfer roller 27 is arranged vis-à-vis the intermediate transfer belt 10 at the secondary transfer position where it is supported by the drive roller 21. A secondary transfer voltage is applied at the secondary transfer position to the toner image on the intermediate transfer belt 10 by means of the secondary transfer roller 27 and by way of a sheet of paper P as a transfer medium supplied from a sheet feeding section 4, for example. As a result, the toner image on the intermediate transfer belt 10 is transferred onto the sheet of paper Pin a secondary transfer operation. A belt cleaner 10*a* is arranged at a downstream position of the intermediate transfer belt 10 relative to the secondary transfer roller 27. The belt cleaner 10*a* collects the toner remaining on the intermediate transfer belt 10 after the completion of the secondary transfer operation as waste toner.

A waste toner box 30, which is a waste toner containing member, is removably fitted to the front side of the image forming section 7 of the color copying machine 1 at a position below the image forming units 11Y, 11M, 11C and 11K, or at the front side of the laser exposure apparatus 17. The waste toner box 30 is an elongate shape arranged along the direction of arrangement of the image forming units 11Y, 11M, 11C and 11K. The waste toner box 30 contains the waste toner collected by the photosensitive member cleaning apparatus 16Y, 16M, 16C and 16K of the image forming units 11Y, 11M, 11C and 11K. The waste toner box 30 also contains the waste toner collected by the belt cleaner 10*a*. When a photo-sensor 38 arranged above the waste toner box 30 detects that the toner box 30 is full, it is replaced by a new one.

Figure 3:
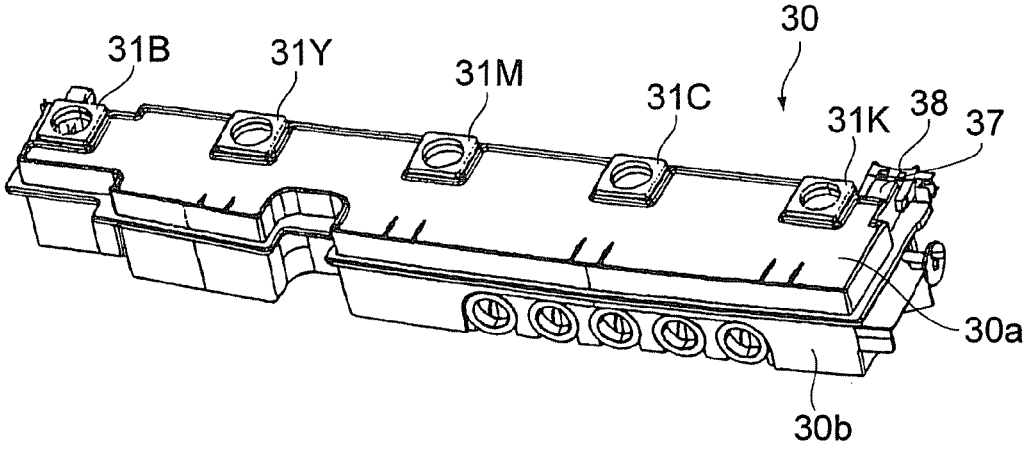
FIG. 3 is a schematic perspective view of a waste toner box according to the embodiment of the present invention.

As shown in FIG. 3, the closure section 30*a* of the waste toner box 30 is formed with first through fifth collection ports 31B, 31Y, 31M, 31C and 31K for the purpose of collecting waste toner. The first collection port 31B is for collecting waste toner brought in from the belt cleaner 10*a*. The second through fifth collection ports 31Y, 31M, 31C and 31K are for collecting the waste toners brought in respectively from the photosensitive member cleaning apparatus 16Y, 16M, 16C and 16K.

Figure 3A:
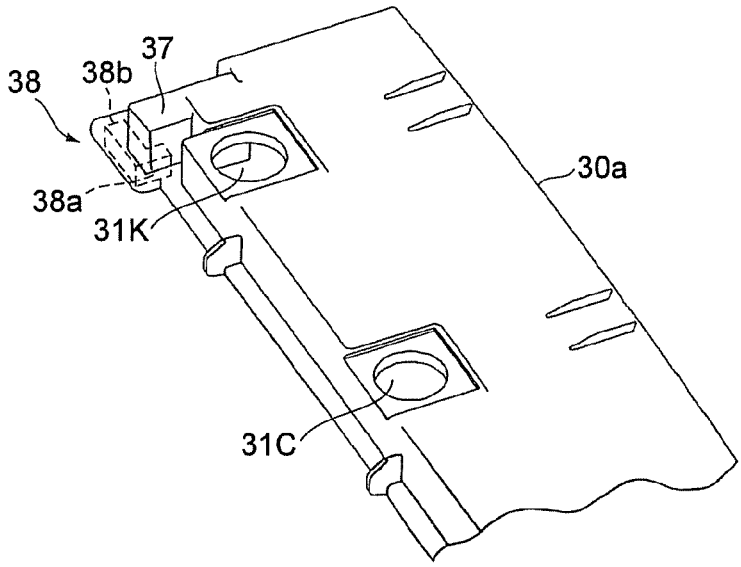
FIG. 3A is a schematic perspective view of a photo-sensor according to the embodiment of the present invention.

The closure section 30*a* is made of a transparent material and provided at an end thereof with a full condition sensing section 37 that is projecting to sense a full condition of the waste toner box 30. As shown in FIG. 3A, a transmission type photo-sensor 38 is fitted to the full condition sensing section 37 from the outside of the latter. The photo-sensor 38 is a full condition sensor adapted to detect a full condition in the inside of the full condition sensing section 37 and comprising a light emitting element 38*a* and a light receiving element 38*b*.

Figure 4:
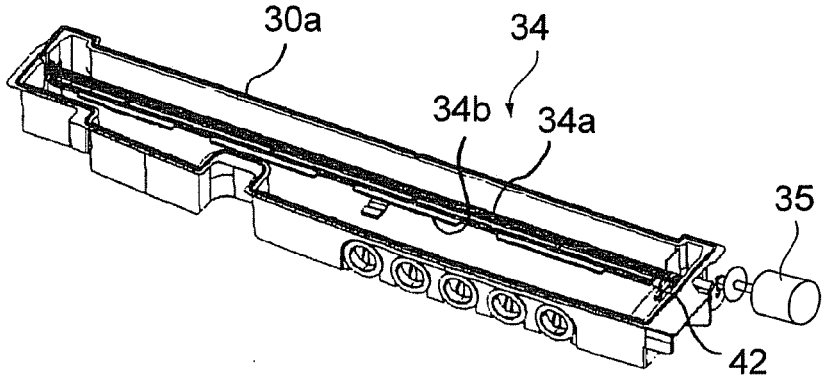
FIG. 4 is a schematic perspective view of the main body section of the waste toner box according to the present invention.
Figure 14:
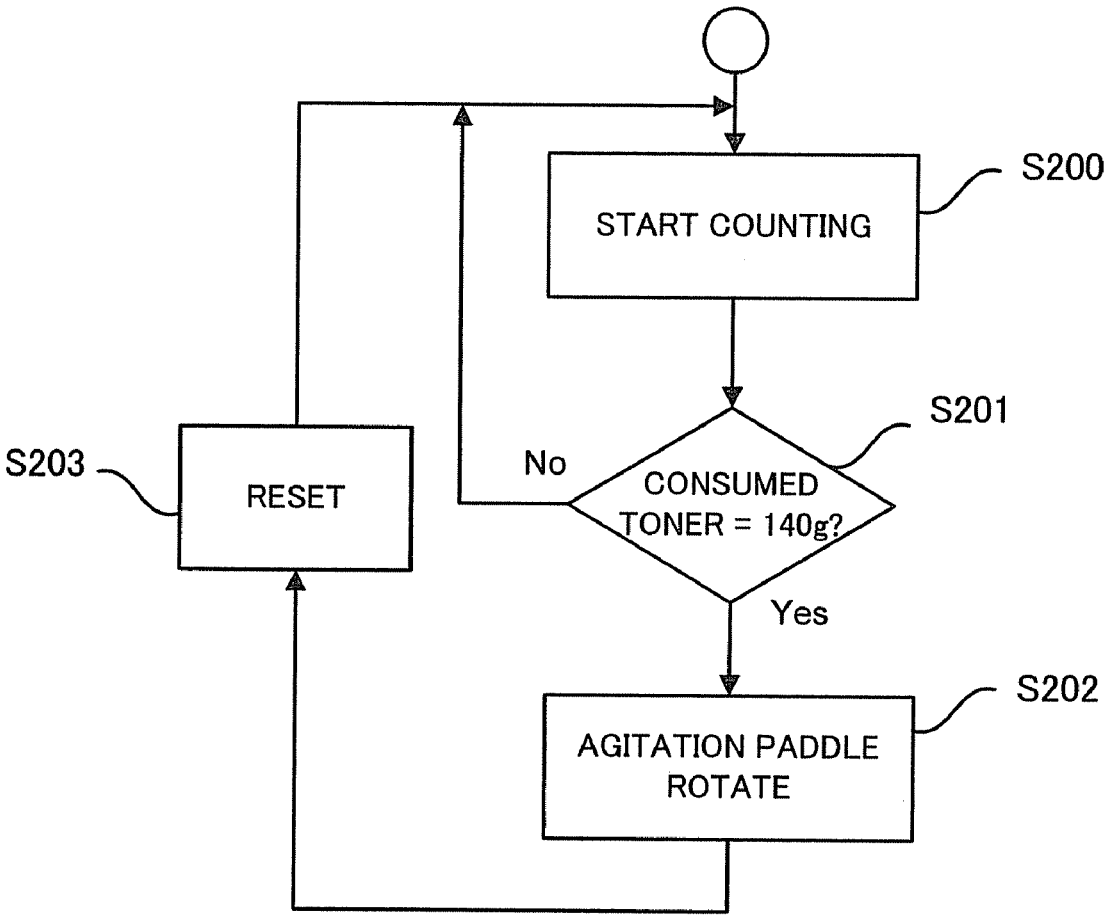
FIG. 14 is a flowchart of the process of controlling the agitation paddle according to the embodiment of the present invention.

As shown in FIG. 4, an agitation paddle 34 that is a leveling member is arranged in the inside of the main body section 30*b* of the waste toner box 30 so as to extend along the entire length of the waste toner box 30. The agitation paddle 34 includes a shaft 34*a* that is a drive shaft and fins 34*b* attached to the shaft 34*a*. The agitation paddle 34 is adapted to fly part of the waste toner that is made to flow in through the first through fifth collection ports 31B, 31Y, 31M, 31C and 31K and accumulated to form heaps by means of fins 34*b* and level the waste toner in the longitudinal direction as the shaft 34*a* thereof is driven to rotate typically by a pulse motor 35.

The pulse motor 35 is by turn driven and controlled by, for example, a control section (not shown) that controls the operation of the entire color copying machine 1. A narrow fin-shaped auxiliary paddle 42 is fitted to the shaft 34*a* of the agitation paddle 34 in an area located vis-à-vis the full condition sensing section 37 for the purpose of supplying waste toner to the full condition sensing section 37.

The agitation paddle 34 is driven to rotate for a predetermined period of time when the waste toner flowed in from any of the collection ports 31B, 31Y, 31M, 31C and 31K gets to a predetermined quantity. The timing at which or the quantity by which the agitation paddle 34 is driven to rotate is predefined for the waste toner collecting apparatus. For example, it may be predefined according to the profile of the waste toner box 30 (so that waste toner may not be accumulated excessively in a small area of a toner containing volume in the waste toner box when the toner containing volume can vary from area to area in the waste toner box due to the design) or the waste toner flow rate of each of the collection ports 31B, 31Y, 31M, 31C and 31K (so that waste toner may not be accumulated near the collection port showing a high waste toner flow rate when the waste toner flow rate can vary from port to port).

The waste toner box 30 of this embodiment shows such a profile that the toner containing volume in the area below the first collection port 31B is small. If toners of different colors are consumed substantially at a same rate, the flow rate of waste toner flowing to the first collection port 31B where the residual toner after a secondary transfer is flowed in is greater than the flow rates of waste toner respectively flowing to the second through fifth collection ports 31Y, 31M, 31C and 31K where the residual toners after a primary transfer are respectively flowed in. Therefore, in this embodiment, the agitation paddle 34 is driven to rotate for five seconds when the waste toner flowing to the first collection port 31B gets to 16 g.

The timing at which or the quantity by which the agitation paddle 34 is driven to rotate may be predefined according to a request of the user regardless of the quantity of waste toner actually flowed into the waste toner box 30. Generally, the quantity of flying toner that adheres to the full condition sensing section 37 is proportional to the number of rotations of the agitation paddle 34. The number of rotations of the agitation paddle 34 may be raised to a level that is unnecessarily high if compared with the quantity of waste toner that is flowed in to presume such a phenomenon. Then, as a result, the rate at which flying toner adheres to the full condition sensing section 37 increased. Then, consequently, photo-sensor 38 senses in error that the waste toner box 30 is full before the waste toner box 30 becomes actually full because of waste toner is supplied to the full condition sensing section 37 at a faster timing, and further the smudge of the full condition sensing section 37. In this way, it is possible to select the timing of sensing a full condition of the waste toner box 30 before the latter becomes actually full according to a request of the user.

Now, the operation of sensing the quantity of waste toner flowed into the waste toner box 30 will be described below. In this embodiment, the quantity of waste toner that is flowed into the waste toner box 30 is not directly measured and sensed by a sensor. More specifically, the quantity of waste toner that is flowed into the waste toner box 30 is estimated and sensed by either of the first method or the second method, which will be described below. The first method is to estimate the quantity of waste toner from the quantity of toner supplied from the toner cartridges 15Y, 15M, 15C and 15K to the development apparatus 14Y, 14M, 14C and 14K. The second method is to estimate the quantity of waste toner from the count values of the pixel counters (not shown) mounted in the color copying machine 1.

The first method will be described to begin with. With the first method, the quantity of toner supplied to the development apparatus 14Y, 14M, 14C and 14K is measured by sensing the number of rotations of or the period of driving/rotating drive motors of the conveyance paddles (not shown) of the toner cartridges 15Y, 15M, 15C and 15K.

The number of rotations of the conveyance paddles of the toner cartridges 15Y, 15M 15C and 15K is measured by sensing the number of rotations of the actuators (not shown) that are arranged at respective extensions of the conveyance paddles 115Y, 115M 115C and 115K. Then, the quantity of the supplied toner is determined by multiplying the number of rotations of the conveyance paddles 115Y, 115M, 115C and 115K by 0.035 g, which is the quantity of toner that is supplied when a conveyance paddle is driven to make a full turn. For example, when the number of rotations of a conveyance paddle is 1,000, the quantity of the supplied toner is 35 g.

When, on the other hand, the quantity of the supplied toner is estimated from the period of driving/rotating the drive motors of the conveyance paddles, the quantity of the supplied toner is determined by multiplying the period of driving/ rotating the drive motors by 0.035 g, which is the quantity of toner that is supplied when a conveyance paddle is driven to maker a full turn. For example, when a drive motor is driven to make 1,000 turns, the quantity of the supplied toner is 35 g.

Then, the quantity of the waste toner is estimated from the quantity of the supplied toners, using the primary transfer ratio from the photosensitive drums 12Y, 12M, 12C and 12K to the intermediate transfer belt 10 by means of the primary transfer rollers 18Y, 18M, 18C and 18K and the secondary transfer ratio from the intermediate transfer belt 10 to a sheet P of paper as shown in (Table 1) of FIG. 5. The agitation paddle 34 is driven to rotate for five seconds when the quantity of the waste toner that is flowed into the first collection port 31B gets to 16 g by the above estimation.

FIG. 5 shows the target primary transfer ratios and the target secondary transfer ratio of the color copying machine 1. The color copying machine 1 tries to make the actual primary transfer ratios and the actual secondary transfer ratio respectively get to the target primary transfer ratios and the target secondary transfer ratio shown in FIG. 5 by adjusting the material of the intermediate transfer belt 10*a*, the toner materials, the primary transfer voltages applied by the primary transfer rollers 18Y, 18M, 18C and 18K and the secondary transfer voltage applied by the secondary transfer roller 27. More specifically, the color copying machine 1 tries to make the primary transfer ratios of yellow (Y) toner, magenta (M) toner, cyan (C) toner and black (K) toner respectively get to 96%, 95%, 94% and 94% and the secondary transfer ratio get to 88%.

For the color copying machine 1 showing the transfer ratios as illustrated in FIG. 5, the quantity of the waste toner flowed into the first collection port 31B gets to 16 g when the total quantity of the supplied yellow (Y), magenta (M), cyan (C) and black (K) toners quantities to 140 g (35×4=140) (for example when the total number of rotations of the conveyance paddles 115Y, 115M, 115C and 115K quantity to 4,000 (1,000×4=4,000)). Then, each of yellow (Y) toner, magenta (M) toner, cyan (C) toner and black (K) toner is supplied by 35 g to make the total quantity of the supplied toners equal to 140 g as shown in (Table 2) of FIG. 6.

In such a case, the quantities of toners of those colors transferred at the primary transfer positions will be 33.60 g for yellow (Y), 33.25 g for magenta (M), 32.90 g for cyan (C) and also 32.90 g for black (K), while toner of each of those colors is supplied by 35 g. The quantities of waste toners of those colors at the primary transfer positions are the remains of toners after the primary transfers. More specifically, they will be 1.40 g for yellow (Y), 1.75 g for magenta (M), 2.10 g for cyan C) and also 2.10 g for black (K).

The quantities of toners of those colors transferred at the secondary transfer positions will be 29.57 for yellow (Y), 29.26 g for magenta (M), 28.95 g for cyan (C) and also 28.95 g for black (K), while toner of each of those colors is supplied by 35 g. The quantities of waste toners of those colors at the secondary transfer position are the remains of toners after the secondary transfer. More specifically, they will be 4.03 g for yellow (Y), 3.99 g for magenta (M), 3.95 g for cyan C) and also 3.95 g for black (K). Thus, the total quantity of the waste toners of yellow (Y), magenta (M), cyan (C) and black (K) will be 15.92 g at the secondary transfer positions.

Thus, as described above, the total quantity of waste toner flowed into the waste toner box 30 from the secondary transfer position is estimated to be about 16 g and sensed, so when the quantities of waste toners of the different colors are substantially equal to each other at the secondary transfer position as in the case of this embodiment, and the total quantity of the toners supplied from any of the toner cartridges 15Y, 15M, 15C and 15K gets to 140 g (if the total number of rotations of the conveyance paddles 115Y, 115M, 115C and 115K gets to 4000). Thus, the agitation paddle 34 is driven to rotate for five seconds and level the waste toner in the waste toner box 30 when the total quantity of the toners supplied from any of the toner cartridges 15Y, 15M, 15C and 15K gets to 140 g.

Now, the second method of estimating the quantity of waste toner from the count values of the pixel counters will be described below. With the second method, the quantities of toners used respectively in the development apparatus 14Y, 14M, 14C and 14K are determined from the count values of the pixel counters and the image density selected by the user on the control panel to estimate the quantity of waste toner. The quantity of toner that is consumed per count is grasped in advance.

If, for example, the quantity of toner that is consumed per count is 0.035 g, the values read from the pixel counters are multiplied by 0.035 g that is the quantity of toner consumed per count. Then, the products are multiplied by the correction coefficient for the corresponding image density as shown in (Table 3) of FIG. 7 to correct the quantity of the consumed toner. When a reference value of 1 is used as correction coefficient for the ordinary density, the correction coefficient is reduced to 0.9 and then to 0.8 as the image density is reduced so as to reduce the quantity of toner to be consumed, whereas the correction coefficient is increased to 1.1 and then to 1.2 as the image density is increased to increase the quantity of toner to be consumed.

The quantity of the consumed toners as determined from the count values of the pixel counters corresponds to the quantity of the supplied toners as determined by the first method. Therefore, when the total quantity of the consumed yellow (Y), magenta (M), cyan (C) and black (K) toners gets to 140 g from the values of the pixel counters, the total quantity of the waste toner flowed into the waste toner box 30 from the secondary transfer position is estimated to be about 16 g. Therefore, when the total quantity of the consumed toners gets to 140 g, the agitation paddle 34 is driven to rotate for five seconds to level the waste toner in the waste toner box 30.

Now, the correction to be made on the quantity of waste toner will be described below. The target values of transfer ratios of the color copying machine 1 shown in FIG. 5 change depending on the environment of the machine when forming an image, the transfer bias voltage values of the transfer rollers, the type of the sheet of paper for forming an image and so on. When the transfer ratios change, the quantity of waste toner as estimated from the quantity of the supplied toners by the first method or the same as estimated from the quantity of the consumed toners by the second method, becomes different from the actual quantity of waste toner. Thus, correction coefficients are determined for each of the above-listed items including the environment of the machine when forming an image, the transfer bias voltage values of the transfer rollers, the type of the sheet of paper for forming an image and so on to correct the rotations of the agitation paddle 34 when the latter is operated.

(Correction Factor 1)

A temperature and humidity sensor (not shown) is arranged on the color copying machine 1 for correction according to the result of the sensor so as to more correctly estimate the quantity of the waste toner. The correction coefficients for fluctuations of temperature, those for fluctuations of relative humidity and those for fluctuations of steam pressure listed in the tables are determined on the basis of the actual quantities of waste toner defecated in image forming tests. They are correction coefficients to be used for correcting the number of rotations of the conveyance paddles and take a reference value of 1. The correction coefficients can also be used to correct the period of the operation of driving the drive motors of the conveyance paddles or the count values of the pixel counters. Any of the correction coefficients is used as multiplier to be applied to the corresponding reference threshold that the agitation paddle 34 is driven to rotate for five seconds once when the conveyance paddles of the toner cartridges are driven to make 4,000 rotations each.

As for correction coefficients for fluctuations of temperature, the environment temperature is made to change between 0° C. and 35° C. relative to the reference temperature of 20° C. to obtain the correction coefficients for correcting the number of rotations of the conveyance paddles listed (in Table 4) in FIG. 8. The threshold for the number of rotations of the conveyance paddles of toner cartridges, or 4,000 rotations, is multiplied by the correction coefficients. Thus, the corrected threshold for the number of rotations of the conveyance paddles is 4,080 for 0° C., 4,060 for 5° C., 4,040 for 10° C., 4,020 for 15° C., 3,980 for 25° C., 3,960 for 30° C. and 3,940 for 35° C. Therefore, when the number of rotations of the conveyance paddles gets to the threshold as determined by applying the correction coefficients for fluctuations of temperature, the agitation paddle 34 is driven to rotate for five seconds once.

As for correction coefficient for fluctuations of relative humidity, the environment humidity is made to change between 10% and 80% relative to the reference humidity of 50% to obtain the correction coefficients for correcting the number of rotations of the conveyance paddles listed in (Table 5) in FIG. 9. The threshold for the number of rotations of the conveyance paddles of toner cartridges, or 4,000 rotations, is multiplied by the correction coefficients. Thus, the corrected threshold for the number of rotations of the conveyance paddles is 4,080 for 10%° C., 4,060 for 20%, 4,040 for 30%, 4,020 for 40%, 3,980 for 60%, 3,960 for 70% and 3,940 for 80%. Therefore, when the number of rotations of the conveyance paddles gets to the threshold as determined by applying the correction coefficients for fluctuations of relative humidity, the agitation paddle 34 is driven to rotate for five seconds once.

As for correction coefficient for fluctuations of steam pressure, the steam pressure is made to change between 1 mmHg and 35 mmHg relative to the reference steam pressure of 20 mmHg to obtain the correction coefficients for correcting the number of rotations of the conveyance paddles listed in (Table 6) in FIG. 10. The threshold for the number of rotations of the conveyance paddles of toner cartridges, or 4,000 rotations, is multiplied by the correction coefficients. Thus, the corrected threshold for the number of rotations of the conveyance paddles is 4,080 for 1 mmHg, 4,060 for 5 mmHg, 4,040 for 10 mmHg, 4,020 for 15 mmHg, 3,980 for 25 mmHg, 3,960 for 30 mmHg and 3,940 for 35 mmHg. Therefore, when the number of rotations of the conveyance paddles gets to the threshold as determined by applying the correction coefficients for fluctuations of steam pressure, the agitation paddle 34 is driven to rotate for five seconds once.

(Correction Factor 2)

For the purpose of minimizing the fluctuations of the transfer ratios due to environmental changes and achieving the target values listed in FIG. 5, e.g., the primary transfer bias voltage is made to change to determine the correction coefficients for different bias voltages and estimate the quantity of waste toner more accurately. The correction coefficients for different bias voltages are determined on the basis of the actual quantities of waste toner defecated in image forming tests. Like the (correction factor 1), they are correction coefficients to be used for correcting the number of rotations of the conveyance paddles and take a reference value of 1. The correction coefficients can also be used to correct the period of the operation of driving the drive motors of the conveyance paddles or the count values of the pixel counters. Any of the correction coefficients is used as multiplier to be applied to the corresponding reference threshold that the agitation paddle 34 is driven to rotate for five seconds once when the conveyance paddles of the toner cartridges are driven to make 4,000 rotations each.

The primary transfer bias voltage is made to change between 500V and 4,000V relative to the reference primary transfer bias voltage of 2,000V to obtain the correction coefficients for correcting the number of rotations of the conveyance paddles listed (in Table 7) in FIG. 11. The threshold for the number of rotations of the conveyance paddles of toner cartridges, or 4,000 rotations, is multiplied by the correction coefficients. Thus, the corrected threshold for the number of rotations of the conveyance paddles is 3,940 for 500V, 3,960 for 1,000V, 3,980 for 1,500V, 4,020 for 2,500V, 4,040 for 3,000V, 4,060 for 3,500V and 4,080 for 4,000V. Therefore, when the number of rotations of the conveyance paddles gets to the threshold as determined by applying the correction coefficients for fluctuations of primary transfer bias voltage, the agitation paddle 34 is driven to rotate for five seconds once.

(Correction Factor 3)

The quantity of waste toner varies depending on the type of the sheets used for copying (generally, the quantity of waste toner increases as the sheet thickness increases). Therefore, the correction coefficients are determined in advance depending on the thickness of the sheets used for copying. The correction coefficients for different sheet thicknesses are determined on the basis of the actual quantities of waste toner defecated in image forming tests. The correction coefficient for the reference sheet is defined to be equal to 1.10. As shown (in Table 8) in FIG. 12, the correction coefficient is 1.05 for thin sheets, 1.10 for ordinary sheets, 1.15 for thick sheets category 1, 1.20 for thick sheets category 2, 1.25 for thick sheets category 3 and 1.30 for thick sheets category 4.

The definitions of sheets are listed (in Table 9) in FIG. 13. A thin sheet is not more than 64 g/m$^2$, an ordinary sheet is between 64 and 105 g/m$^2$, a thick sheet category 1 is between 106 and 163 g/m$^2$, a thick sheet category 2 is between 164 and 209 g/m$^2$, a thick sheet category 3 is between 210 and 256 g/m$^2$ and a thick sheet category 4 is not less than 256 g/m$^2$. For corrections according to the type of sheet, the number of rotations of the conveyance paddles of the toner cartridges, the period of driving the drive motors of the conveyance paddles to rotate or the count values of the pixel counters are multiplied by the corresponding correction coefficient. For example, when images are formed on thick sheets category 4, waste toner of 1.3 rotations of the conveyance paddles is defecated when the conveyance paddles are only driven to make a full turn.

(Correction factor 1) through (Correction factor 3) may be combined for use. For example, when images are formed on thick sheets category 4 (correction coefficient: 1.3) in an environment showing a steam pressure of 25 mmHg (correction coefficient: 0.995), the threshold of the number of rotations of the conveyance paddles for driving the agitation paddle 34 to rotate is 3,980 rotations. Additionally, from the type of sheets, waste toner of 1.3 rotations of the conveyance paddles is defecated when the conveyance paddles are only driven to make a full turn. Thus, the threshold of the number of rotations of the conveyance paddles for driving the agitation paddle 34 to rotate is 3,980/1.3=3,060.

Now, the operation of an image forming apparatus will be described. As an image forming process is started in this condition, image information is input from the scanner or the terminal of a personal computer and the photosensitive drums 12Y, 12M, 12C and 12K are driven to rotate to sequentially perform image forming operations in the image forming units 11Y, 11M, 11C and 11K. For instance, the surface of the photosensitive drum 12Y is uniformly charged with electricity by the electric charger 13Y in the yellow (Y) image forming unit 11Y.

Subsequently, a laser beam that corresponds to the input yellow (Y) image information is irradiated onto the photosensitive drum 12Y at the exposure position 17Y to form an electrostatic latent image. Then, a toner image is formed on the photosensitive drum 12Y by the development apparatus 14Y. Thereafter, the photosensitive drum 12Y contacts the intermediate transfer belt 10 that is driven to rotate in the direction of arrow s in FIG. 2 so that the toner image is transferred onto the intermediate transfer belt 10 by means of the primary transfer roller 18Y in a primary transfer operation.

A toner image forming process similar to the above-described yellow (Y) toner image forming process is executed for each of the remaining colors including magenta (M), cyan (C) and black (K). The toner images formed on the photosensitive drums 12M, 12C and 12K are sequentially laid on the intermediate transfer belt 10 one on the other at the position where the yellow (Y) toner image is formed. Thus, a full color toner image is formed on the intermediate transfer belt 10 as a result of the multi-transfer operation for yellow (Y), magenta (M), cyan (C) and black (K).

Thereafter, the full color toner image formed on the intermediate transfer belt 10 by laying the monochromatic toner images gets to the position of the secondary transfer roller 27 and transferred onto a sheet of paper P at a time due to the transfer bias voltage of the secondary transfer roller 27 in a secondary transfer operation. Then, the sheet of paper P is subjected to a fixing process to finish the toner image. If an image is to be formed only on one of the surfaces of the sheet of paper P, the sheet of paper P is discharged to the inter-body sheet eject section 3 after the fixing process. If an image is to be formed on both of the surfaces of the sheet of paper P or a multiplex printing is to be performed, the sheet of paper P is fed once again to the position of the secondary transfer roller 27 by means of a re-conveyance unit (not shown).

Meanwhile, after the secondary transfer operation, the intermediate transfer belt 10 is cleaned by the belt cleaner 10*a* to remove the residual toner. Similarly, after the toner images on the photosensitive drums 12Y, 12M, 12C and 12K are transferred onto the intermediate transfer belt 10 in the primary transfer operation, the photosensitive drums are cleaned respectively by the photosensitive member cleaning apparatus 16Y, 16M, 16C and 16K to remove the residual toners to become ready for the next image forming process.

The waste toner including the residual toners collected respectively by the belt cleaner 10*a* and the photosensitive member cleaning apparatus 16Y, 16M, 16C and 16K are caused to flow into the waste toner box 30 respectively by the waste toner conveyance section 32 of the belt cleaner 10*a* and waste toner conveyance mechanism (not shown) of the photosensitive member cleaning apparatus 16Y, 16M, 16C and 16K. The waste toners conveyed to the waste toner box 30 are flowed into the waste toner box 30 respectively by way of the first through fifth collection ports 31B, 31Y, 31M, 31C and 31K.

As a result, waste toner is accumulated in the waste toner box 30 at positions located below the first through fifth collection ports 31B, 31Y, 31M, 31C and 31K to produce so many heaps of waste toner. The agitation paddle 34 is driven to rotate in order to collapse the heaps and level the waste toner in the waste toner box 30. Note that the agitation paddle 34 is not driven to rotate until the quantity of waste toner gets to a predetermined level so as to minimize flying toner that is occurred when the agitation paddle 34 is operated to smudge the full condition sensing section 37 because such smudge can give rise to an erroneous detection of a full condition.

As the image forming process is started, a counter starts counting for the quantity of the toners supplied by toner cartridges 15Y, 15M, 15C and 15K or the pixel counters start counting for the quantities of the consumed toners in Step S200 in order to control the operation of the agitation paddle 34. Then, in Step 201, the total quantity of toner, supplied from the toner cartridges 15Y, 15M, 15C and 15K or consumed by any of the development apparatus 14Y, 14M, 14C and 14K is compared with 140 g until the total quantity gets to that value (and the quantity of waste toner flowed to the first collection port 31B gets to 16 g).

In reality, the rotations of the actuators arranged respectively at the conveyance paddles 115Y, 115M, 115C and 115K of the toner cartridges 15Y, 15M, 15C and 15K are detected by means of sensors in Step 201. Then, the total number of rotations of the conveyance paddles 115Y, 115M, 115C and 115K is compared with 4,000 (the product of multiplication of 4,000 and one or more than one correction coefficients when the 4,000 rotations are corrected due to the environmental conditions, the transfer bias voltage and/or the type of sheets).

The operation waits until the total quantity of the supplied toner gets to 140 g (and the total number of rotations of the conveyance paddles gets to 4,000 or the corrected number) in Step 201 and then proceeds to Step 202. The agitation paddle 34 is driven to rotate for five seconds in Step 202 and then the operation proceeds to Step 203. The quantity of supplied toner or that of consumed toner is reset to 0 g (and the sensors for detecting the rotations of the actuators of the conveyance paddles 115Y, 115M, 115C and 115K are reset) in Step 203 and the operation returns to Step 200.

As a result, the agitation paddle 34 is driven to rotate when the waste toner flowed to the first collection port 31B of the waste toner box 30 and accumulated in the waste toner box 30 gets to 16 g. Thus, a situation where the agitation paddle 34 is driven to operate although the quantity of waste toner is small is prevented. Then, it is possible to prevent excessive flying toner from being occurred because the agitation paddle 34 is driven to operate unnecessarily. In a test, the agitation paddle 34 was operated to rotate to see the waste toner collected in the waste toner box 30. The photo-sensor 38 never detected a full condition of the waste toner box 30 in error until the waste toner box 30 substantially becomes full.

Thus, in the above-described embodiment, the agitation paddle 34 is driven to rotate for five seconds to level the heaps of waste toner in the waste toner box 30 when the quantity of waste toner flowed to the first collection port 31B of the waste toner box 30 gets to 16 g. Therefore, there never occurs a situation where the agitation paddle 34 is driven to operate to produce excessive flying toner although the quantity of waste toner in the waste toner box 30 is small. As a result, it is possible to minimize the flying toner that adheres to the full condition sensing section 37 and hence prevent the photo-sensor 38 from detecting a full condition in error due to the flying toner adhering to the full condition sensing section 37.

Then, the sensing accuracy is improved and hence the waste toner box can be effectively exploited.

Additionally, it is possible to estimate the quantity of waste toner from the quantity of the toners supplied from the toner cartridges 15Y, 15M, 15C and 15K or the quantity of the consumed toners according to the count values of the pixel counters so that the quantity of waste toner collected in the waste toner box 30 can be grasped with ease. Furthermore, correction coefficients are determined for environmental changes, different types of sheets and so on to correct the threshold for the number of rotations of the conveyance paddles. Therefore, it is possible to estimate and sense the quantity of waste toner highly accurately from the accurate quantity of the supplied toners or that of the consumed toners.

The period of operation of the agitation paddle 34 is not limited to the above-cited one for this embodiment. For example, depending on the request from the user, the agitation paddle 34 may be driven to rotate for ten seconds when the quantity of waste toner flowed to the first collection port 31B gets to 16 g to double the number of rotations of the agitation paddle 34. Alternatively, the agitation paddle 34 may be driven to rotate for five seconds when the quantity of waste toner flowed to the first collection port 31B gets to 8 g. Then, waste toner is supplied to the full condition sensing section 37 at a faster timing, and further more flying toner will adhere to the full condition sensing section 37 of the waste toner box 30 to contaminate the full condition sensing section 37 earlier.

In a test, the operation of collecting waste toner in the waste toner box 30 was observed by changing the period of the operation of driving the agitation paddle 34 to rotate. The obtained results are summarily shown in (Table 10) in FIG. 15. Referring to FIG. 15, the quantities of waste toner collected in the waste toner box 30 are 350 g, 300 g, 250 g and 230 g for the periods of the operation of driving the agitation paddle 34 to rotate of 5 seconds, 10 seconds, 15 seconds and 20 seconds respectively.

In another test, the operation of collecting waste toner in the waste toner box 30 was observed by changing the threshold for driving the agitation paddle 34 to rotate. The obtained results are summarily shown in (Table 11) in FIG. 16. Referring to FIG. 16, the quantities of waste toner collected in the waste toner box 30 are 350 g, 300 g, 250 g and 230 g when the quantities of waste toners for rotation threshold are 16 g, 8 g, 5 g and 4 g respectively. Thus, it is proved that the photosensor 38 of the full condition sensing section 37 senses a full condition in error before the waste toner box 30 actually becomes full.

Thus, it is possible to adjust the timing of sensing a full condition of the waste toner box 30 by adjusting the number of rotations of the agitation paddle 34 if necessary. For example, when the waste toner box 30 becomes full, there arises a risk of spilling waste toner by mistake while replacing the waste toner box 30. However, the waste toner box 30 may have a little space if the full condition sensing section 37 senses a full condition when the full condition sensing section 37 is adjusted to sense a full condition prematurely. Then, the risk of spilling waste toner by mistake can reliably be prevented when replacing the waste toner box 30.

The present invention is by no means limited to the above-described embodiment, which may be modified in various different ways without departing from the spirit and scope of the invention. For example, the waste toner leveling member may be operated according to the quantity of waste toner flowed in from the primary transfer side or from the secondary transfer side depending on the profile and/or the mode of operation of the image forming apparatus. The quantity of waste toner that provides the threshold for driving the leveling member to rotate is not limited if it is found within a range that neither damages nor locks the waste toner collecting mechanism and ensures safe operations. Furthermore, the number of rotations of the leveling member and the period of driving the leveling member to rotate may be changed appropriately if necessary. Finally, the quantity of waste toner may alternatively be measured by means of a flow meter that directly measures the quantity of waste toner flowed into the waste toner box.

What is claimed is:

1. An image forming apparatus comprising:

a plurality of image forming units respectively having an image carrier and a developer to develop an electrostatic latent image on the image carrier;

a waste toner container to receive a waste toner defecated from the plurality of image forming units; and a leveler to rotate in the waste toner container according to a quantity of the toners supplied respectively to the plurality of image forming units.

2. The apparatus according to claim 1, further comprising:

a plurality of conveyance paddles to rotate to supply the toners to the developers; and wherein the quantity of the toners supplied respectively to the plurality of image forming units is detected from the number of rotations of the conveyance paddles.

3. The apparatus according to claim 1, further comprising:

a plurality of conveyance paddles to rotate to supply the toners to the developers; and wherein the quantity of the toners supplied respectively to the plurality of image forming units is detected from the period of the operation of driving the conveyance paddles.

4. The apparatus according to claim 1, wherein the quantity of waste toner is detected from count values of pixel counters for counting the respective numbers of pixels formed on the image carriers.

5. The apparatus according to claim 1, wherein the number of rotations of the leveler is adjustable.

6. The apparatus according to claim 5, wherein the number of rotations of the leveler is adjusted according to the required timing of sensing a full condition.

* * * * *